US011959147B2

(12) United States Patent
Murakami et al.

(10) Patent No.: US 11,959,147 B2
(45) Date of Patent: Apr. 16, 2024

(54) LANCE NOZZLE

(71) Applicant: JFE STEEL CORPORATION, Tokyo (JP)

(72) Inventors: Yumi Murakami, Tokyo (JP); Nobuhiko Oda, Tokyo (JP); Yusuke Fujii, Tokyo (JP); Goro Okuyama, Tokyo (JP); Shota Amano, Tokyo (JP); Shinji Koseki, Tokyo (JP); Shingo Sato, Tokyo (JP); Yukio Takahashi, Tokyo (JP); Ryo Kawabata, Tokyo (JP); Naoki Kikuchi, Tokyo (JP); Atsuo Yuasa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 191 days.

(21) Appl. No.: 17/601,481

(22) PCT Filed: Apr. 2, 2020

(86) PCT No.: PCT/JP2020/015189

§ 371 (c)(1),
(2) Date: Oct. 5, 2021

(87) PCT Pub. No.: WO2020/209173

PCT Pub. Date: Oct. 15, 2020

(65) Prior Publication Data

US 2022/0154299 A1 May 19, 2022

(30) Foreign Application Priority Data

Apr. 9, 2019 (JP) ..... 2019-074289

(51) Int. Cl.
*C21C 5/46* (2006.01)

(52) U.S. Cl.
CPC ..... *C21C 5/4606* (2013.01)

(58) Field of Classification Search
CPC ..... C21C 5/4606; F27D 3/16
See application file for complete search history.

(56) References Cited

U.S. PATENT DOCUMENTS 6,017,380 A 1/2000 Kitamura et al.
2003/0010155 A1 1/2003 Sumi et al.

FOREIGN PATENT DOCUMENTS

CN 1168157 A 12/1997
CN 1395622 A 2/2003
(Continued)

OTHER PUBLICATIONS

Apr. 26, 2022 Office Action and Search Report issued in Chinese Patent Application No. 202080022410.X.
(Continued)

*Primary Examiner* — Scott R Kastler
(74) *Attorney, Agent, or Firm* — Oliff PLC

(57) ABSTRACT

A top-blowing lance nozzle is configured to freely switch an adequate expansion condition so as to control an oxygen-blowing amount and a jetting velocity independently of each other without requiring a plurality of lance nozzles or a mechanically movable part. A lance nozzle is configured to blow refining oxygen to molten iron charged in a reaction vessel while a gas is blown from a top-blowing lance to the molten iron. One or more blowing holes for blowing a working gas are on an inner wall side surface of the nozzle, at a site where the lance nozzle has a minimum cross-sectional area in a nozzle axis direction or at a neighboring site of the site.

12 Claims, 5 Drawing Sheets

(56) References Cited

FOREIGN PATENT DOCUMENTS

| | | | | | |
|---|---|---|---|---|---|
| CN | 1661119 | A | | 8/2005 | |
| CN | 1887443 | A | | 1/2007 | |
| CN | 101805814 | A | | 8/2010 | |
| JP | H10-30110 | A | | 2/1998 | |
| JP | 2000-234115 | A | | 8/2000 | |
| JP | 2000-234116 | A | | 8/2000 | |
| JP | 2004-156083 | A | | 6/2004 | |
| JP | 2007077489 | A | * | 3/2007 | |
| JP | 2019-077934 | A | | 5/2019 | |
| KR | 20140079188 | A | * | 12/2012 | ..... F27D 3/16 |

OTHER PUBLICATIONS

Apr. 20, 2022 extended Search Report issued in European Patent Application No. 20786715.1.
Oct. 31, 2022 Office Action issued in Korean Patent Application No. 10-2021-7032063.
May 25, 2021 Office Action issued in Japanese Patent Application No. 2020-544305.
Nov. 11, 2020 Office Action and Search Report issued in Taiwanese Patent Application No. 109111674.
Jun. 16, 2020 Search Report issued in International Patent Application No. PCT/JP2020/015189.

* cited by examiner

FIG. 3
FIG. 3(a)
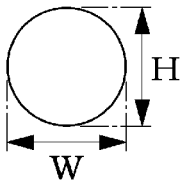
FIG. 3(b)
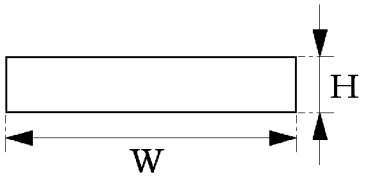
FIG. 3(c)
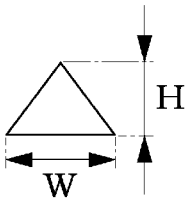

Cross section cut along line A-A' in FIG. 2

LANCE NOZZLE

TECHNICAL FIELD

The present invention relates to a lance nozzle configured to perform oxygen-blowing refining of molten iron charged in a reaction vessel by blowing a gas from a top-blowing lance to the molten iron.

BACKGROUND ART

In oxidation refining of molten iron, in order to improve reaction efficiency or a yield, blowing is performed in which a jet flow velocity and a flow rate of an oxygen-containing gas jetted from a lance nozzle of a top-blowing lance onto a bath surface of the molten iron are controlled. For example, in decarburization refining of molten iron in a converter at an ironworks, at an initial or intermediate stage of blowing in which a carbon concentration in the molten iron is high, an operation of increasing a flow rate of oxygen jetted from a top-blowing lance nozzle is performed for the purpose of improving decarburization efficiency. On the other hand, at a final stage of blowing in which the carbon concentration in the molten iron is low, an operation of suppressing the flow rate of oxygen is performed so as to avoid a decrease in yield due to excessive iron oxidation.

In order to meet such an adequate operating condition different between at the initial and intermediate stages of blowing and at the final stage of blowing, Patent Literature 1 proposes a method in which, with respect to an adequate expansion exit diameter D determined from a throat diameter d of a Laval nozzle and an oxygen-blowing flow rate F, a lance nozzle having an exit diameter of 0.85 D to 0.94 D is used in a high carbon concentration region, and a lance nozzle having an exit diameter of 0.96 D to 1.15 D is used in a low carbon concentration region.

Furthermore, Patent Literature 2 proposes a Laval nozzle, a throat port of which is mechanically overlaid with another Laval nozzle having a blowout port identical in area and shape with the throat port, to thus enables an operation under both of an adequate expansion condition for the initial or intermediate stage of blowing and an adequate expansion condition for the final stage of blowing.

CITATION LIST

Patent Literature

Patent Literature 1: Japanese Patent Laid-Open No. 10-30110

Patent Literature 2: Japanese Patent Laid-Open No. 2000-234115

SUMMARY OF INVENTION

Technical Problem

The method of Patent Literature 1 has, however, a problem that it requires two different lance nozzles to be used respectively for blowing in the high carbon concentration region and for blowing in the low carbon concentration region, involving switching between the two lance nozzles during blowing. There is another problem that lance nozzle replacement during blowing requires the blowing to be stopped while the lance nozzle replacement is performed, which interferes with the operation. Moreover, there is also a problem that an increased number of lance nozzles on standby during blowing requires a wider space and complicated facilities.

Furthermore, the method of Patent Literature 2 in which a nozzle shape is mechanically changed has a problem that a mechanically movable part is provided in a high temperature atmosphere and in that, when applied to a nozzle having a plurality of spouts, the structure of a nozzle body and peripheral equipment of the nozzle are complicated. In addition, there is also a problem that the movable part includes a part where friction occurs between itself and an inner wall of the nozzle, causing wearing of a lance nozzle to affect the service life of a lance.

An object of the present invention is to provide a top-blowing lance nozzle configured to freely switch an adequate expansion condition to control an oxygen-blowing amount and a jetting velocity independently of each other without requiring a plurality of lance nozzles or a mechanically movable part.

Solution to Problem

In order to solve the above-described problems, the inventors have found that a blowing hole for blowing an oxygen-containing gas is provided at a particular site on an inner wall of a lance nozzle and the gas is fed through the blowing hole to form a fluid wall inside the nozzle so that an apparent throat diameter of the nozzle is changed, which can achieve both of adequate expansion conditions respectively for high and low carbon concentration regions of molten iron.

That is, the present invention provides a lance nozzle configured to blow refining oxygen to molten iron charged in a reaction vessel by blowing a gas from a top-blowing lance to the molten iron, characterized in that at least one blowing hole for blowing a working gas is provided on an inner wall side surface of the nozzle at a site where the lance nozzle has a minimum cross-sectional area in a nozzle axis direction or at a neighboring site of the site.

In the lance nozzle configured as above according to the present invention, the followings are considered to provide more preferred solutions:

(1) the blowing hole has a ratio of a hole height to a hole lateral width of not less than 0.15 and not more than 1.0;

(2) in the neighboring site of the site where the nozzle has a minimum cross-sectional area in the nozzle axis direction, the nozzle has a cross-sectional area in the nozzle axis direction not more than 1.1 times the minimum cross-sectional area in the nozzle axis direction;

(3) respective centers of the blowing holes lie on the same plane perpendicular to a center axis of the nozzle;

(4) two or more blowing holes identical in shape and opening area are arranged at an equal distance from each other;

(5) a total of hole lateral widths of respective openings of the blowing holes is not less than 25% and not more than 75% of a circumference of the nozzle; and (6) no steeply enlarged part is provided in a vicinity of each of the openings of the blowing holes.

In the present invention, throughout the description, a "hole height" of the blowing hole refers to a height of the blowing hole at a part of the blowing hole having a maximum length in the nozzle axis direction, regardless of the shape of the blowing hole, and a "hole lateral width" of the blowing hole refers to a width of the blowing hole at a part of the blowing hole having a maximum length in a direction perpendicular to an axis of the blowing hole regardless of the shape of the blowing hole. Furthermore, a "cross-sectional area" of the nozzle refers to an area of the inside of the nozzle perpendicular to the center axis. Thus, in the present invention, a "site where the nozzle has a cross-sectional area not more than 1.1 times the minimum cross-sectional area" refers to a site where the nozzle has a cross-sectional area of more than 1.0 to not more than 1.1 times the minimum cross-sectional area.

Advantageous Effects of Invention

According to the present invention, a gas from another system referred to as a working gas is fed through the blowing holes provided, on the inner wall side surface of the nozzle at a site where the nozzle has a minimum cross-sectional area in the nozzle axis direction or at a neighboring site of the site, to form a fluid wall inside the nozzle. As a result, it has become possible to apparently change an open area ratio of the nozzle in accordance with a feeding amount of the working gas so as to control an oxygen-blowing amount and a jetting velocity independently of each other.

BRIEF DESCRIPTION OF DRAWINGS

FIGS. 3(*a*) to 3(*c*) are views for explaining some examples of a shape of a blowing hole for blowing a working gas.

DESCRIPTION OF EMBODIMENT

Description of Embodiment of Present Invention

Figure 1:
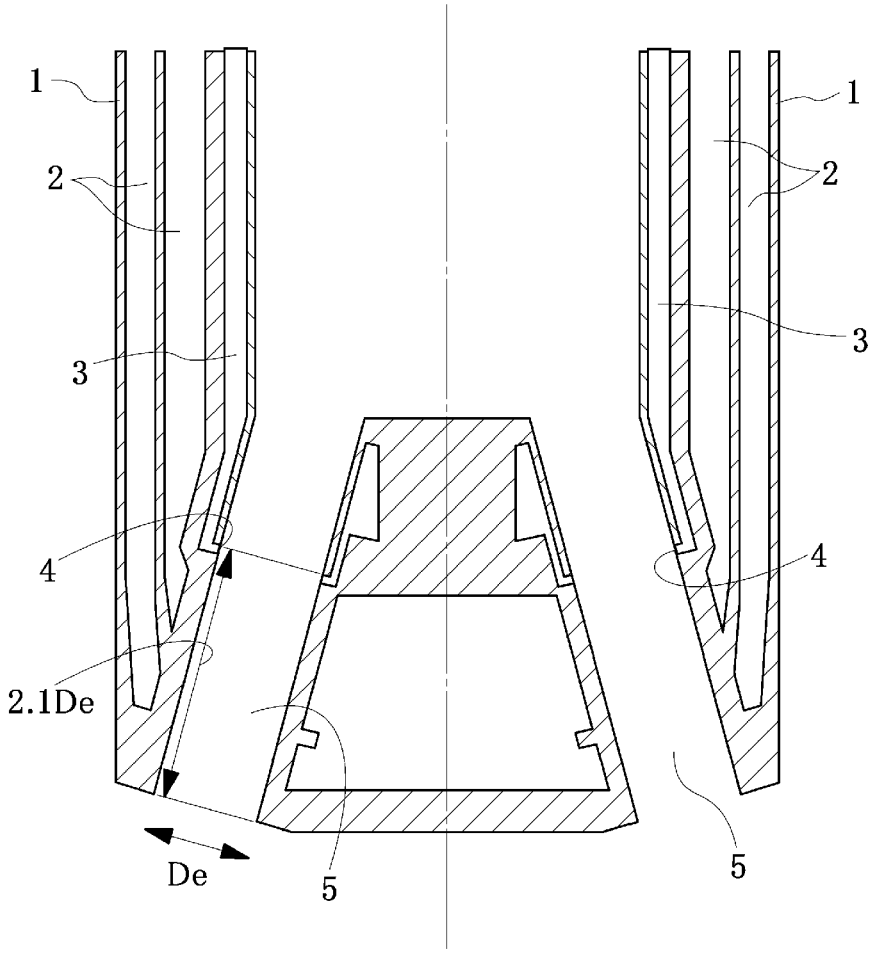
FIG. 1 is a sectional view showing, as an example, a structure of a lance nozzle according to the present invention (an example of a straight nozzle).
Figure 2:
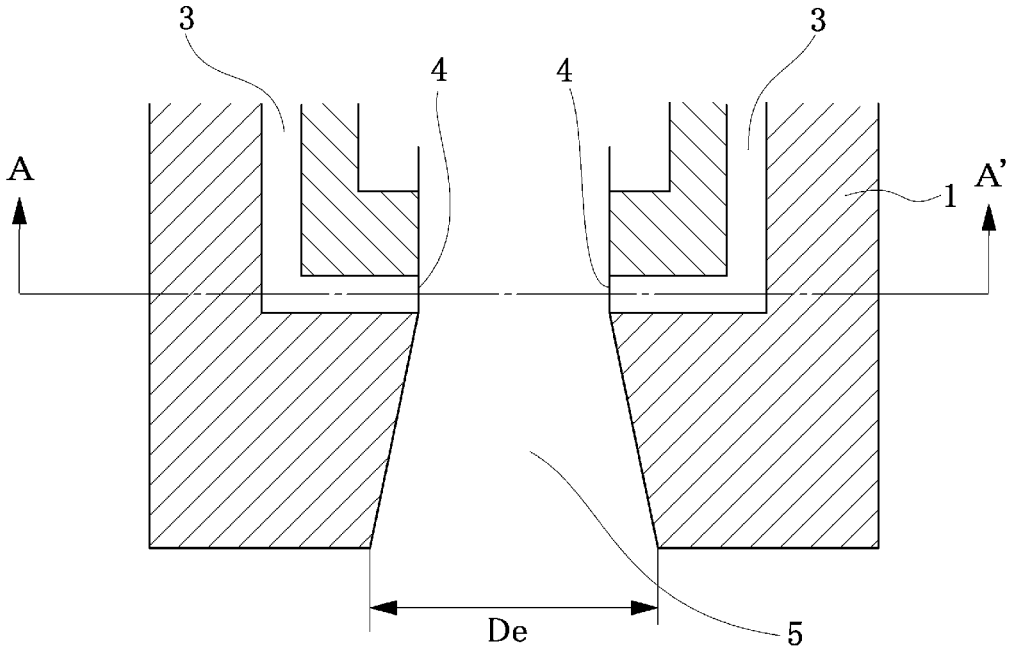
FIG. 2 is a sectional view showing, as another example, a structure of the lance nozzle according to the present invention (an example of a Laval nozzle).

FIG. 1 is a sectional view showing, as an example, a structure of a lance nozzle according to the present invention (an example of a straight nozzle). FIG. 2 is a sectional view showing, as another example, a structure of the lance nozzle according to the present invention (an example of a Laval nozzle). In each of the examples shown in FIG. 1 and FIG. 2, a cylindrical lance nozzle 1 includes, in a coaxial manner, a coolant circulation path 2 for cooling the lance nozzle 1 and a working gas feed path 3 inside the coolant circulation path 2. Further, blowing holes 4 for blowing a working gas from the working gas feed path 3 are provided, on an inner wall side surface of the nozzle at a site where the lance nozzle 1 has a minimum cross section in a nozzle axis direction or at a neighboring site of the site. Furthermore, numeral 5 denotes a main hole nozzle for blowing, and an oxygen-containing gas for refining stored in a lance secondary pressure vessel is spouted into a converter via the main hole nozzle 5 for blowing.

In the straight nozzle shown in FIG. 1, an inner wall of the nozzle on which the blowing holes 4 are provided has a constant diameter across an entire length of the nozzle, and the blowing holes 4 are provided on the inner wall side surface of the nozzle at a site where the lance nozzle 1 has a minimum cross section in the nozzle axis direction. In the Laval nozzle shown in FIG. 2, an inner wall of the nozzle on which the blowing holes 4 are provided has a diameter increasing toward an outlet of the nozzle, and the blowing holes 4 are provided on the inner wall side surface of the nozzle at a neighboring site of a site where the lance nozzle 1 has a minimum cross-sectional area in the nozzle axis direction. The following describes effects obtained by blowing a working gas through the blowing holes 4 into the main hole nozzle 5 for blowing in the present invention.

In a case where a working gas is spouted through the blowing holes under a condition that a total gas flow rate of a gas jetted from the lance nozzle 1 is set to be constant and a condition that insufficient expansion is brought about when no working gas is introduced, a phenomenon is observed in which a jet flow velocity is increased. Furthermore, in a case where a working gas is spouted through the blowing holes 4 under the condition that a total gas flow rate of a gas jetted from the lance nozzle 1 is set to be constant and a condition that excessive to adequate expansion is brought about when no working gas is introduced, a phenomenon is observed in which the jet flow velocity is decreased. Conceivably, the above-described phenomena occur as a result of the following. That is, in a neighborhood of the blowing holes 4, the working gas causes a main feed gas flowing parallel to the axis direction to be peeled off from the inner wall of the nozzle (and the working gas forms a fluid wall on the inner wall of the nozzle), so that a cross-sectional area of the nozzle is apparently decreased to cause a transition of an adequate expansion condition.

First, under the condition that insufficient expansion is brought about when no working gas is introduced, when the cross-sectional area of the nozzle is decreased, i.e., an open area ratio of the nozzle is apparently increased, an adequate expansion pressure Po determined by Equation (1) below is increased, so that an expansion state of a jet flow shifts from an insufficient expansion condition to approach an adequate expansion condition, and thus energy efficiency is improved. Furthermore, also under a condition that adequate to excessive expansion is brought about when no working gas is introduced, similarly to the above, the adequate expansion pressure Po is increased, so that there occurs a transition of an expansion state of a jet flow toward excessive expansion, and thus energy efficiency is decreased.

$$Ae/At=(5^{5/2}/6^{3})\times(Pe/Po)^{-5/7}\times[1-(Pe/Po)^{2/7}]^{-1/2} \quad (1),$$

where At denotes a minimum cross-sectional area ($mm^2$) of a jetting nozzle, Ae denotes an outlet cross-sectional area ($mm^2$) of the jetting nozzle, Pe denotes an atmospheric pressure (kPa) at an outlet of the nozzle, and Po denotes an adequate expansion pressure (kPa) of the nozzle.

In the present invention, as described above, a designed pressure is switched based on presence/absence of a working gas to cause energy efficiency of a jet flow to also vary, and thus a flow rate can be independently controlled even at the same total gas flow rate. As a result, it has become possible to apparently change the open area ratio of the nozzle in accordance with a feeding amount of a working gas so as to control an oxygen-blowing amount and a jetting velocity independently of each other.

<Description of Shape and Arrangement of Blowing Holes 4 for Blowing Working Gas>

FIGS. 3(*a*) to 3(*c*) are views for explaining examples of a shape of a blowing hole for blowing a working gas. In each of the examples shown in FIGS. 3(*a*) to 3(*c*), a blowing hole 4, which is formed on a circumferential side surface of the cylindrical lance nozzle 1, can hardly be illustrated in a planar form as it is. Thus, a shape of the blowing hole 4 is considered herein by expanding the circumferential shape of the blowing hole 4 on a plane. Herein, a "hole height" of the blowing hole 4 is defined to be a height of the blowing hole 4 at a part of the blowing hole 4 having a maximum length in the nozzle axis direction regardless of the shape of the blowing hole 4, and a "hole lateral width" of the blowing hole 4 is defined to be a width of the blowing hole 4 at a part of the blowing hole 4 having a maximum axial length in a plane perpendicular to an axis of the blowing hole 4 regardless of the shape of the blowing hole 4. Specifically, in each of a circular blowing hole 4 shown in FIG. 3(*a*), a rectangular blowing hole shown in FIG. 3(*b*), and a triangular blowing hole 4 shown in FIG. 3(*c*), the hole height is denoted by a reference character H, and the hole lateral with is denoted by a reference character W. Furthermore, also in a case of any other shape, the hole height H and the hole lateral width W can be determined by similar definitions.

In the above-described shapes of the blowing hole 4 for blowing a working gas, it is preferable to set a ratio of the hole height to the hole lateral width to not less than 0.15 and not more than 1.0 for the following reasons. That is, when the ratio of the hole height to the hole lateral width is set to less than 0.15, a fluid wall formed in a vicinity of the blowing holes 4 has a shape abruptly and perpendicularly bulges in the nozzle axis direction, and thus a pressure loss is generated to decrease energy efficiency, so that an effect of the working gas cannot be sufficiently obtained. Furthermore, when the ratio of the hole height to the hole lateral width is set to more than 1.0, a fluid wall is formed in a reduced region with respect to a plane perpendicular to a nozzle axis, and thus the open area ratio can be changed only within a narrower range, so that the effect of the working gas is attenuated. For the above-described reasons, it is preferable to set the ratio of the hole height to the hole lateral width of the blowing hole 4 to not less than 0.15 and not more than 1.0.

In the straight nozzle shown in FIG. 1, no matter where on the inner wall of the nozzle the blowing holes 4 are formed, the blowing holes 4 are provided on the inner wall side surface of the nozzle at a site where the lance nozzle 1 has a minimum cross section in the nozzle axis direction. As an example, the blowing holes 4 are provided at a position at a distance 2.1 De from the outlet of the nozzle when De denotes a nozzle outlet diameter.

In the Laval nozzle shown in FIG. 2, illustrated is a view for explaining positions at which blowing holes for blowing a working gas are provided. In the Laval nozzle shown in FIG. 2, the effect of apparently decreasing a cross-sectional area of the nozzle by spouting a working gas from the side surface of the nozzle is not necessarily limited to a case where the blowing holes 4 are placed exactly at a site where a jetting nozzle has a minimum cross-sectional area in a jetting nozzle axis direction. The effect of increasing a jet flow velocity can be most efficiently obtained when the blowing holes 4 are placed at this site, and an analogous effect of increasing the jet flow velocity may be obtained also in a case where the blowing holes 4 are provided at a site close to the minimum cross-sectional area in the jetting nozzle axis direction. However, when the jetting nozzle has an increased cross-sectional area at a position in the jetting nozzle axis direction at which the blowing holes 4 are placed, a large amount of working gas is required, so that efficiency in increasing the jet flow velocity may be decreased, and thus it is preferable to place the blowing holes 4 at a site where the nozzle has a cross-sectional area not more than 1.1 times the minimum cross-sectional area.

Figure 4:
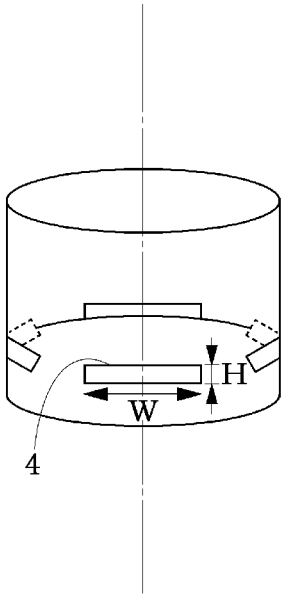
FIG. 4 is a view for explaining an example of how blowing holes for blowing a working gas are arranged in the lance nozzle according to the present invention.

FIG. 4 is a view for explaining an example of how the blowing holes 4 for blowing a working gas are arranged in the lance nozzle according to the present invention. In the lance nozzle according to the present invention, the blowing holes 4 may be provided in the form of a slit extending along an entire circumferential direction of the nozzle. In this case, however, when the slit has an uneven thickness with respect to an entire circumference, there may occur a deflection of a jet flow from a center axis. As a solution to this, it is preferable to arrange two or more (four in FIG. 4) blowing holes 4 at an equal distance from each other on a common plane perpendicular to the nozzle axis direction as shown in FIG. 4.

Figure 5:
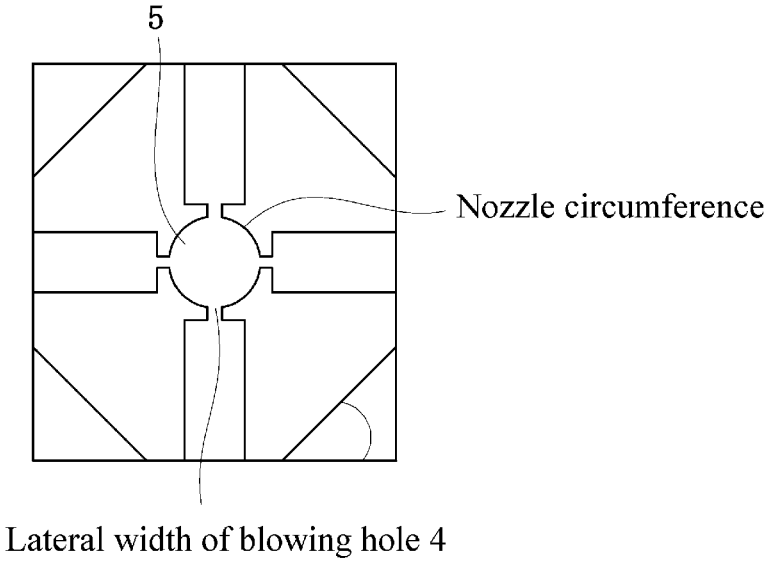
FIG. 5 is a view for explaining a ratio of hole lateral widths of the blowing holes for blowing a working gas to an entire circumference of the lance nozzle according to the present invention.

FIG. 5 is a view for explaining a ratio of hole lateral widths of the blowing holes 4 for blowing a working gas to an entire circumference of the lance nozzle according to the present invention. In a case where two or more blowing holes 4 are arranged as described above, in order to secure the effect of decreasing a cross-sectional area of the nozzle, it is preferable to set a ratio of lateral widths of the blowing holes 4 to a circumference of the nozzle on a common plane perpendicular to the center axis of the lance nozzle (see FIG. 5) to not less than 25% and not more than 75%. Herein, when this ratio is set to less than 25%, the effect of decreasing the cross-sectional area of the nozzle is obtained in an extremely uneven manner with respect to the circumference of the nozzle on the common plane, so that the effect of increasing a flow velocity cannot be sufficiently obtained. Furthermore, when this ratio is set to more than 75%, a uniform shape of the holes can hardly be retained due to deformation by heat or workability, so that a jet flow may be deflected. For this reason, it is preferable to set the ratio to not less than 25% and not more than 75%. Herein, the following equation is established: Ratio of Lateral Widths of Blowing holes 4=(Lateral Width of Each of Blowing holes 4×Number of the Holes)/(Circumference of Nozzle).

Figure 6A:
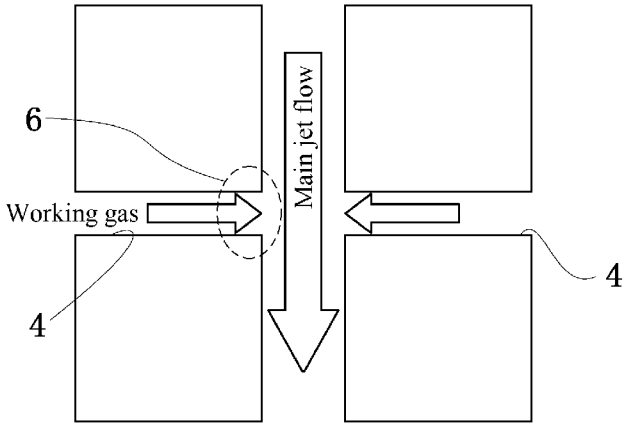
FIG. 6(*a*) is a view for explaining an example in which no stepped part is provided in a vicinity of an opening of the blowing hole of the lance nozzle according to the present invention, and FIG. 6(*b*) is a view for explaining an example in which a stepped part is provided in the vicinity of an opening of the blowing hole of the lance nozzle according to the present invention.
Figure 6B:
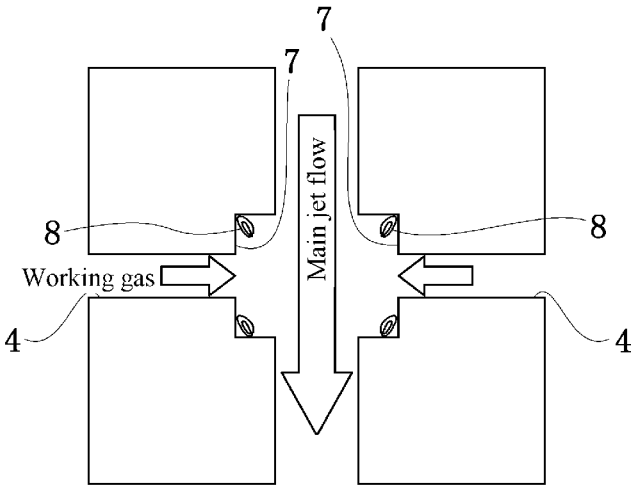

FIG. 6(*a*) is a view for explaining an example in which no stepped part is provided in a vicinity of each of respective openings of the blowing holes of the lance nozzle according to the present invention, and FIG. 6(*b*) is a view for explaining an example in which a stepped part is provided in the vicinity of each of the openings. As for the shape of the blowing holes 4 for blowing a working gas of the lance nozzle 1 according to the present invention, it is desirable to adopt a structure including no stepped part in a vicinity of an opening 6 of each of the blowing holes 4 as shown in FIG. 6(*a*) for the following reasons. That is, in a case of including a stepped part 7 in the vicinity of the opening 6 as shown in FIG. 6(*b*), a flow may be peeled off at the stepped part 7 to generate a stagnation spot 8, inhibiting a main jet flow to attenuate the effect of increasing a flow velocity. Moreover, in a case of having the stagnation spot 8, a flow in a vicinity of the stagnation spot 8 is disturbed, and thus the stagnation spot 8 possibly causes abnormal wear of the lance nozzle. For the above-described reasons, the blowing holes 4 are desired to have, in the vicinity of the opening 6, a flat shape including no steeply enlarged part such as the stepped part 7.

EXAMPLES

Example 1

A lance nozzle formed of the straight nozzle shown in FIG. 1 is used to perform a flow velocity measurement using a particle image velocimetry method (PIV method). The PIV method is a measurement method in which a particle following a fluid is introduced as a tracer into the fluid, and the tracer is visualized by laser sheet irradiation. In this experiment, a silicone oil mist having a particle size adjusted to 1 μm to 2 μm is used as the tracer, and a gas used is compressed air. The flow velocity measurement is performed under flow rate conditions shown in Table 1 by use of the straight nozzle having a nozzle main hole inner diameter of 6.6 mm. In the straight nozzle, at positions on an inner wall of the nozzle at 14 mm from an outlet of the nozzle, blowing holes for feeding a working gas were provided, the number, shape, dimensions, and ratio of a hole height to a hole lateral width of which are shown in Table 1. As a result, there can be obtained an average flow velocity and an average velocity increase ratio with respect to absence of a control gas, which are shown in Table 1.

As seen from the result shown in Table 1, compared with Comparative Examples 1 to 8 in which no working gas is fed through the blowing holes, Invention Examples 1 to 8 of the present invention in which a working gas is fed through the blowing holes exhibit an improvement in the average velocity increase ratio. It has also been found that, among Invention Examples 1 to 8 of the present invention, Invention Examples 2 to 4 and Invention Examples 6 to 8 of the present invention with a ratio of the hole height to the hole lateral width of not less than 0.15 and not more than 1.0 exhibit a higher average velocity increase ratio than and thus are preferred to Invention Examples 1 and 5 of the present invention with a ratio of the hole height to the hole lateral width of less than 0.15.

Example 2

Furthermore, a flow velocity measurement using the PIV method is performed by use of a Laval nozzle having a throat diameter of 6 mm, an outlet diameter of 6.6 mm, and an open area ratio of 1.21, which is a lance nozzle including various types of working gas holes provided at a minimum circumference part of the nozzle as a throat part (designed to be a part at 14 mm from an outlet of the nozzle). Table 2 shows measurement conditions used and a result of the measurement.

TABLE 1

| | Blowing hole | | | Hole | Flow rate condition | | | | Average |
|---|---|---|---|---|---|---|---|---|---|
| | Number of holes Hole(s) | Shape — | Dimension mm | height/hole lateral width — | Flow rate of main hole gas $Nm^3$/min | Flow rate of working gas $Nm^3$/min | Ratio of working gas — | Average flow velocity m/s | velocity increase ratio with respect to absence of working gas — |
| Invention Example 1 | 4 | Rectangular | Width 1.6 × height 0.16 | 0.1 | 0.808 | 0.202 | 0.2 | 225.41 | 1.19 |
| Invention Example 2 | 4 | Rectangular | Width 1.3 × height 0.2 | 0.15 | | | | 235.16 | 1.26 |
| Invention Example 3 | 4 | Rectangular | Width 2.6 × height 0.5 | 0.58 | | | | 245.59 | 1.28 |
| Invention Example 4 | 4 | Circular | Radius φ 1.3 | 1 | | | | 234.54 | 1.30 |
| Invention Example 5 | 2 | Rectangular | Width 1.6 × height 0.16 | 0.1 | | | | 216.35 | 1.15 |
| Invention Example 6 | 2 | Rectangular | Width 1.3 × height 0.2 | 0.15 | | | | 229.78 | 1.22 |
| Invention Example 7 | 2 | Rectangular | Width 2.6 × height 0.5 | 0.58 | | | | 238.91 | 1.25 |
| Invention Example 8 | 2 | Circular | Radius φ 1.3 | 1 | | | | 227.59 | 1.24 |
| Comparative Example 1 | 4 | Rectangular | Width 1.6 × height 0.16 | 0.1 | 1.01 | 0 | 0 | 189.42 | — |
| Comparative Example 2 | 4 | Rectangular | Width 1.3 × height 0.2 | 0.15 | | | | 187.02 | — |
| Comparative Example 3 | 4 | Rectangular | Width 2.6 × height 0.5 | 0.58 | | | | 191.97 | — |
| Comparative Example 4 | 4 | Circular | Radius φ 1.3 | 1 | | | | 180.84 | — |
| Comparative Example 5 | 2 | Rectangular | Width 1.6 × height 0.16 | 0.1 | | | | 188.86 | — |
| Comparative Example 6 | 2 | Rectangular | Width 1.3 × height 0.2 | 0.15 | | | | 188.53 | — |
| Comparative Example 7 | 2 | Rectangular | Width 2.6 × height 0.5 | 0.58 | | | | 190.65 | — |
| Comparative Example 8 | 2 | Circular | Radius φ 1.3 | 1 | | | | 183.25 | — |

TABLE 2

| | Blowing hole | | | | Flow rate condition | | | | Average velocity |
|---|---|---|---|---|---|---|---|---|---|
| | Number of holes Hole(s) — | Shape — | Dimension mm | Hole height/hole lateral width — | Flow rate of main hole gas $Nm^3/min$ | Flow rate of working gas $Nm^3/min$ | Ratio of working gas — | Average flow velocity m/s | increase ratio with respect to absence of working gas — |
| Invention Example 9 | 4 | Rectangular | Width 1.6 × height 0.16 | 0.1 | 0.976 | 0.244 | 0.2 | 297.13 | 1.11 |
| Invention Example 10 | 4 | Rectangular | Width 1.3 × height 0.2 | 0.15 | | | | 321.66 | 1.19 |
| Invention Example 11 | 4 | Rectangular | Width 2.6 × height 0.5 | 0.58 | | | | 324.51 | 1.22 |
| Invention Example 12 | 2 | Rectangular | Width 1.6 × height 0.16 | 0.1 | | | | 291.24 | 1.08 |
| Invention Example 13 | 2 | Rectangular | Width 1.3 × height 0.2 | 0.15 | | | | 299.41 | 1.10 |
| Invention Example 14 | 2 | Rectangular | Width 2.6 × height 0.5 | 0.58 | | | | 315.34 | 1.15 |
| Comparative Example 9 | 4 | Rectangular | Width 1.6 × height 0.16 | 0.1 | 1.22 | 0 | 0 | 268.78 | — |
| Comparative Example 10 | 4 | Rectangular | Width 1.3 × height 0.2 | 0.15 | | | | 270.39 | — |
| Comparative Example 11 | 4 | Rectangular | Width 2.6 × height 0.5 | 0.58 | | | | 267.03 | — |
| Comparative Example 12 | 2 | Rectangular | Width 1.6 × height 0.16 | 0.1 | | | | 268.66 | — |
| Comparative Example 13 | 2 | Rectangular | Width 1.3 × height 0.2 | 0.15 | | | | 271.17 | — |
| Comparative Example 14 | 2 | Rectangular | Width 2.6 × height 0.5 | 0.58 | | | | 273.25 | — |

As seen from the result shown in Table 2, compared with Comparative Examples 9 to 14 in which no working gas is fed through the blowing holes, Invention Examples 9 to 14 of the present invention in which a working gas is fed through the blowing holes exhibit an improvement in the average velocity increase ratio. It has also been found that, among Invention Examples 9 to 14 of the present invention, Invention Examples 10, 11, 13, and 14 of the present invention with a ratio of the hole height to the hole lateral width of not less than 0.15 and not more than 1.0 exhibit a higher average velocity increase ratio than and thus are preferred to Invention Examples 1, 9 and 12 of the present invention with a ratio of the hole height to the hole lateral width of less than 0.15. This is a tendency similar to that in the case of the straight nozzle, and it can be said that it is desirable to set the ratio of the hole height to the hole lateral width of a nozzle to not less than 0.15 and not more than 1.0 regardless of whether the nozzle is a straight nozzle or a Laval nozzle.

INDUSTRIAL APPLICABILITY

The lance nozzle of the present invention is usable in all of decarburization blowing, dephosphorization blowing, and desiliconization blowing. Furthermore, this technique is applicable to any refining process using a lance nozzle such as, for example, refining in an electric furnace. This technique is effective particularly in a case where it is desired to increase a jet flow velocity or a dynamic pressure without changing other gas feed conditions. For example, in a preliminary dephosphorization treatment of hot metal using a converter type refining furnace, when a top-blown oxygen gas feed velocity is decreased in accordance with a decrease in dephosphorization oxygen efficiency at a final stage of refining, an oxygen-blowing refining method using the lance nozzle of the present invention in which a decrease in top-blown jet flow velocity is suppressed using a working gas is applied, and thus a decrease in dephosphorization reaction efficiency can be suppressed.

REFERENCE SIGNS LIST

1 lance nozzle
2 coolant circulation path
3 working gas feed path
4 blowing hole
5 main hole nozzle for blowing
6 opening
7 stepped part
8 stagnation spot

The invention claimed is:

1. A lance nozzle configured to blow refining oxygen to molten iron charged in a reaction vessel by blowing a gas from a top-blowing lance to the molten iron, wherein one or more blowing holes for blowing a working gas into a main hole nozzle of the lance nozzle are provided on an inner wall side surface of the nozzle at a site where the lance nozzle has a minimum cross-sectional area in a nozzle axis direction or at a neighboring site of the site, wherein the working gas is received from outside of the reaction vessel, wherein in the neighboring site, the nozzle has a cross-sectional area in the nozzle axis direction of not more than 1.1 times the minimum cross-sectional area in the nozzle axis direction, and wherein a total of hole lateral widths of respective openings of the blowing holes is not less than 25% and not more than 75% of a circumference of the nozzle.

2. The lance nozzle according to claim 1, wherein the blowing hole has a ratio of a hole height to a hole lateral width of not less than 0.15 and not more than 1.0.

3. The lance nozzle according to claim 1, wherein respective centers of the blowing holes lie on a common plane perpendicular to a center axis of the nozzle.

4. The lance nozzle according to claim 1, wherein two or more blowing holes identical in shape and opening area are arranged at an equal distance from each other.

5. The lance nozzle according to claim 1, wherein no stepped part is provided in a vicinity of each of openings of the blowing holes.

6. The lance nozzle according to claim 2, wherein respective centers of the blowing holes lie on a common plane perpendicular to a center axis of the nozzle.

7. The lance nozzle according to claim 3, wherein respective centers of the blowing holes lie on a common plane perpendicular to a center axis of the nozzle.

8. The lance nozzle according to claim 2, wherein two or more blowing holes identical in shape and opening area are arranged at an equal distance from each other.

9. The lance nozzle according to claim 3, wherein two or more blowing holes identical in shape and opening area are arranged at an equal distance from each other.

10. The lance nozzle according to claim 2, wherein no stepped part is provided in a vicinity of each of openings of the blowing holes.

11. The lance nozzle according to claim 3, wherein no stepped part is provided in a vicinity of each of openings of the blowing holes.

12. The lance nozzle according to claim 1, wherein the blowing hole has a ratio of a hole height to a hole lateral width of not less than 0.15 and not more than 0.58.

* * * * *